US005685644A

United States Patent [19]

Taylor

[11] Patent Number: 5,685,644

[45] Date of Patent: Nov. 11, 1997

[54] BULK CARGO BAG

[75] Inventor: Jeanne S. Taylor, Houston, Tex.

[73] Assignee: Jumbo Bag Corporation, Houston, Tex.

[21] Appl. No.: 654,301

[22] Filed: May 28, 1996

[51] Int. Cl.[6] ..... B65D 33/14; B65D 30/10

[52] U.S. Cl. ..... 383/24; 383/105; 383/109; 383/903

[58] Field of Search ..... 383/24, 105, 117, 383/109, 121, 121.1, 903

[56] References Cited

U.S. PATENT DOCUMENTS

| | | | |
|---|---|---|---|
| 3,949,901 | 4/1976 | Tokita | 383/105 X |
| 4,946,291 | 8/1990 | Schnaars | 383/113 |
| 4,948,265 | 8/1990 | Futerman | 383/117 X |
| 5,328,267 | 7/1994 | Cuddy et al. | 383/105 X |
| 5,468,528 | 11/1995 | Schnaars et al. | 383/107 X |
| 5,556,205 | 9/1996 | Gallie et al. | 383/105 X |
| 5,564,833 | 10/1996 | Proffitt | 383/105 X |

FOREIGN PATENT DOCUMENTS

| | | | |
|---|---|---|---|
| 2824929 | 12/1979 | Germany | 383/24 |

*Primary Examiner*—Jes F. Pascua

*Attorney, Agent, or Firm*—Vinson & Elkins, L.L.P.

[57] ABSTRACT

A fabric bag for handling dry bulk cargo is disclosed, of the type in which four sides, a top and bottom are assembled to approximate the shape of a right quadrilateral prism. A continuous fabric liner is provided inside the bag and four corner baffles are sewn into the liner so as to offset a portion of the lateral outward loading due to the dry bulk cargo and thereby reduce bulging of the bag sides. Since the baffles are stitched only to the liner, and not to the outer sides of the bags, this leaves the central portions of the bag sides free of stitching and available for improved display of graphic or textual material.

20 Claims, 4 Drawing Sheets

BULK CARGO BAG

FIELD OF THE INVENTION

This invention relates to large, box-shaped, cargo bags, typically one cubic yard or larger in capacity, of the type which are used for handling and transporting commercial quantities of dry bulk cargo. By the term "dry bulk cargo" is meant dry, or low moisture, powdered, granular or pelletized products such as grains, fertilizers, chemicals, etc. which are substantially free-flowing, when in bulk form. More specifically, this invention relates to an improvement which makes such bags more "flat-sided" so as to make their shape more closely resemble that of a box or crate (i.e., a right quadrilateral prism).

BACKGROUND OF THE INVENTION

Very large quantities of free-flowing dry bulk cargo, such as grains, fertilizers and chemicals, typically are transported by means of tankers, barges, hopper cars, etc. However, intermediate quantities of such chemicals, from a few cubic feet to a few cubic yards, typically are handled as bagged or boxed cargo. One type of heavy-duty bag for handling such intermediate quantities of dry bulk cargo which has become increasingly popular in recent years is six sided (four sides plus a top and bottom), generally rectilinear, and formed of a heavy woven fabric, which can be a man-made fiber, but more typically is a polymer, such as woven polypropylene fiber. Such bags typically hold about one or more cubic yards of dry bulk cargo and can be handled by readily available equipment such as forklifts and transported in conventional trucks or cargo containers.

In fact, a principal advantage of such so-called "flat-sided" bulk cargo bags is that they fit into conventional rectangular transport vehicles such as trailers and cargo containers with less wasted space than do the generally cylindrical intermediate size bulk cargo bags previously used. Also, having substantially flat tops and bottoms, they can be stacked on top of each other, with further space saving economies.

The advantages of flat-sided bulk cargo bags over cylindrical bags are in direct proportion to the flatness of their sides when filled with cargo. All such bags tend to bulge out somewhat at the sides due to lateral displacement forces exerted by the free-flowing cargo. If they were formed merely with four sides, a top and a bottom, their shape when filled would differ little from that of cylindrical intermediate sized bulk cargo bags. To improve upon the shape of the filled bags, the prior art has tried a variety of devices for improving the flatness and overall shape of the filled bags. The most common such technique utilizes four corner baffles stitched into the interior of the bag. The baffles offset somewhat the displacement forces of the cargo and help maintain a more square configuration for the loaded bags. While this has improved the shape of the bags somewhat, there still tend to be very prominent side bulges when the bag is filled. Additionally, multiple rows of vertical stitching through the bag walls is necessary for attaching the baffles. These rows of stitches make the outer wall surfaces less attractive and less functional for imprinting trademarks, designs, warnings, or other graphic or textual material on the exteriors of the bags. These rows of stitching used for attaching the baffles also may tend to weaken the outer walls in some cases and, when the bag is fully loaded, will tend to pull the fabric, creating small openings through which cargo, or cargo dust or powder, can escape.

SUMMARY OF THE INVENTION

Accordingly, it is the primary object of the present invention to provide an improved structure for rectilinear bulk cargo bags.

Another object is to provide such an improved structure in which the sides of the bags, when filled, are flatter than prior art bags, so that the shape of the filled bag more closely approximates that of a right quadrilateral prism.

Another such object is to provide such a structure wherein the outside surfaces of the four sides of the bag have larger areas free from stitching, which stitching-free areas may be used for improved imprinting of graphic and textual information.

A further object is to provide such a bag which includes an inner liner attached to the upper periphery of the bag walls, and with interior corner baffles attached to the liner, but not to the bag walls, which structure both improves the flatness of the filled bag and eliminates stitching over most of the exterior bag walls. This, in turn, improves the strength of the outer bag walls and reduces their tendency to allow cargo, or cargo powder or dust, to escape.

A further object is to provide a bulk cargo bag which has its bottom permanently affixed to a cargo pallet, or the like, to improve handling and stacking characteristics.

These and other objects and advantages of the invention will become apparent from the following disclosure and description of a preferred embodiment of the invention and from the accompanying drawings and claims.

BRIEF DESCRIPTION OF THE DRAWINGS

In the accompanying drawings, which form a portion of the original disclosure of the invention and in which like numerals indicate like parts.

DETAILED DESCRIPTION OF THE PREFERRED EMBODIMENT OF THE INVENTION

Figure 1:
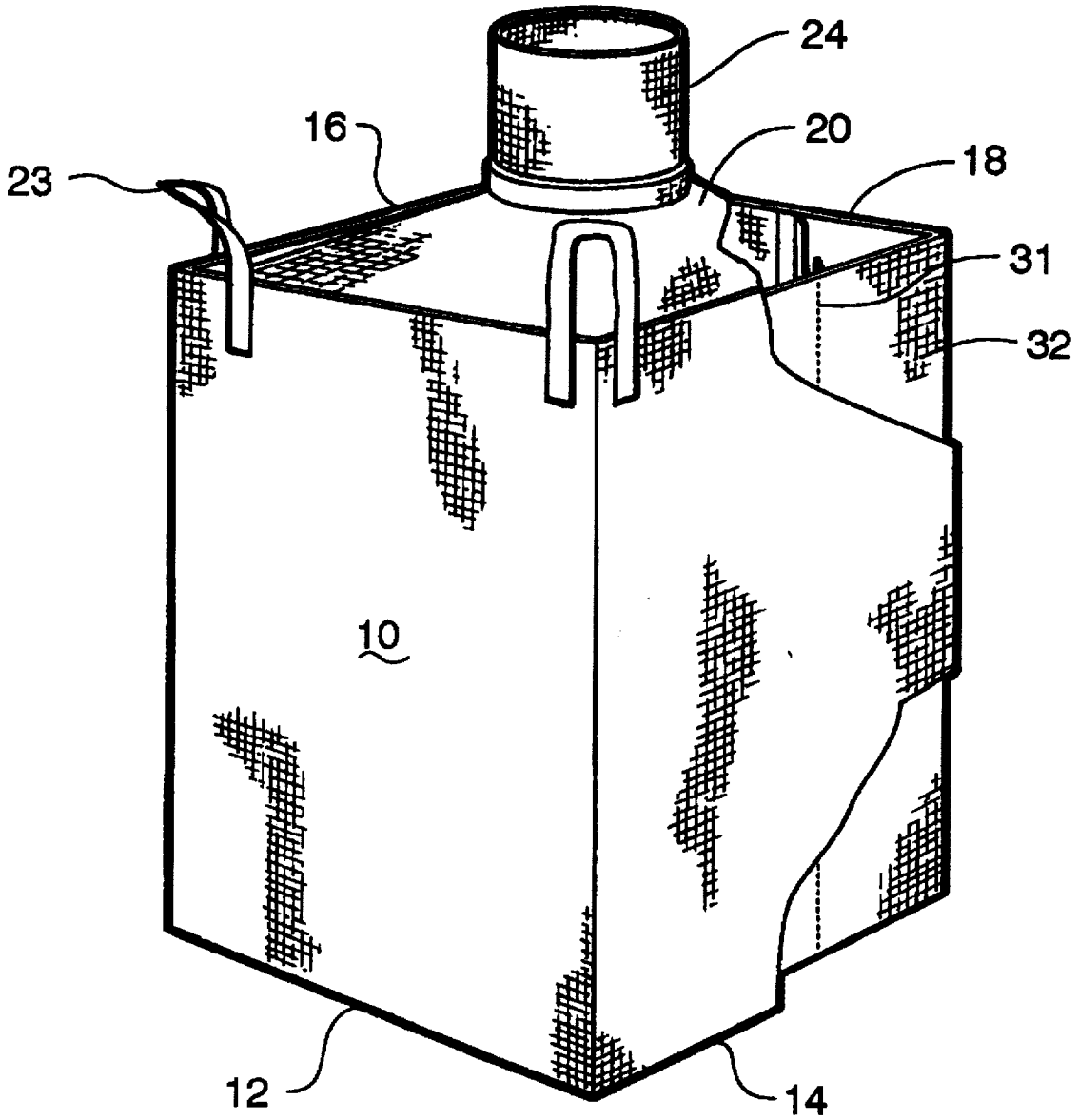
FIG. 1 is a view in perspective of a rectilinear bulk cargo bag in accordance with the present invention in which the outer surface of the bag has been partly cut away to show the inner liner and part of the baffle structure.

Referring now to FIG. 1, there is illustrated in perspective view a bulk cargo bag 10 formed in accordance with the present invention. The bag 10 comprises an outer body formed of four sides, 12, 14, 16 and 18, a top 20 and a bottom 22, assembled to approximate the shape of a right quadrilateral prism. The panels comprising the body of the bag preferably are formed of a woven polymer such as polypropylene, but also may be formed of any natural or synthetic fiber, paper or polymer film, depending upon the volume and weight to be carried. The material used for forming the bag body, as well as the stitching and other elements must be sturdy enough to support the anticipated weight of the cargo to be carried by the bag.

Re-closable opening means preferably are provided in the body for loading and discharging cargo. Preferably, the top panel 20 of the bag has a central opening to which is attached a cylindrical neck 24 for use in filling and emptying the bag. Once the bag is filled, the neck can be twisted closed and fastened with a tie wire, clamp or the like and then folded flat against the top of the bag. A similar re-closeable opening and neck may be provided in the bottom panel of the bag for use in emptying cargo, without the necessity of turning the bag upside down. Alternate types of reclosable openings may be used. For example, some bags omit the top panel of the bag and provide instead a skirt attached to the upper periphery of the four side walls, which skirt can be gathered in the center and closed with a tie wire or other closure means after the bag is filled. In bags used for certain types of cargo, the top panel may eliminated altogether and the open top bag used for cargo handling and storage. Where it is not desired to re-use the cargo bags, some bags are emptied merely by slitting open the bottom panel of the bags. Thus, it will be appreciated, that both the top panel of the bag body and the reclosable opening means are optional features of the bag body.

Lifting means also are provided attached to said bag body for cooperating with powered equipment used for handling and moving the loaded bags. In the disclosed embodiment, these are provided by the four loop-type handles 23, stitched to the four upper corners of the cargo bag. Alternatively, the bag may be placed on or attached to a cargo pallet and handled by means of a forklift, in which event the pallet would serve as the lifting means.

Figure 2:
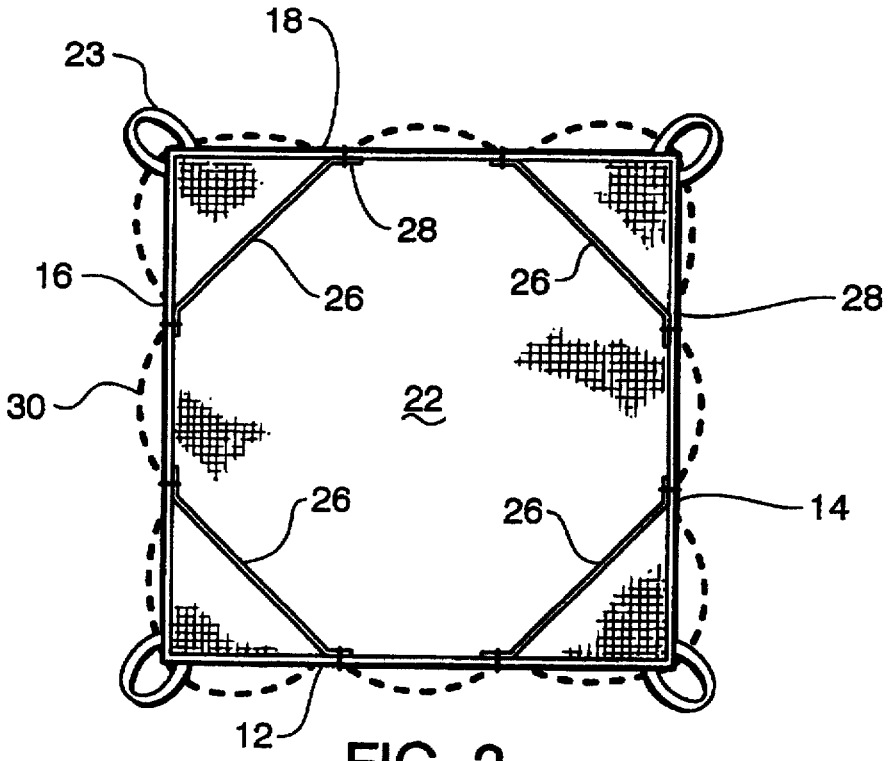
FIG. 2 (PRIOR ART)
FIG. 2 is a plan view of a prior art rectilinear bulk cargo bag, illustrating the prior art interior baffle structure and illustrating, in phantom lines, the deformed configuration which such a prior art bag tends to assume when filled with dry bulk cargo.

Referring to FIG. 2, there is shown in plan view a cross section of a typical prior art rectilinear bulk cargo bag which includes four corner baffles 26, each extending substantially the full height of the bag. The baffles may have suitable openings, not shown, for the purpose of allowing cargo to flow from the center of the bag to the corner portions behind the baffles, as the bag is filled, and out again, as the bag is emptied.

One vertical edge of each corner baffle 26 is attached by one or more lines of vertical stitching 28 to one of the four sides of the bag body 10, and the other vertical edge is similarly attached by stitching 28 to an adjacent side of the bag body. It will be appreciated that, when so attached, the baffles will act as braces, offsetting a portion of the lateral displacement forces on the sides of the bag body due to the weight of the cargo. The result is to help rigidify and flatten somewhat the outer surfaces of the four sides of the bag when the bag is filled with dry bulk cargo. However, the sides of the bag will still tend to bulge somewhat in the areas between the corners and the lines of vertical baffle stitching. The result tends to be three elongated vertical bulges on each of the four sides of the bag, as illustrated by the phantom lines 30. Also, when the bag is loaded, the pull of the baffle stitches may tend to weaken somewhat the outer walls of the bag and also may tend to cause small openings in the fabric through which small particles of cargo, or cargo dust or powder, can escape.

In constructing this prior art structure, the body of the bag is formed of four separate panels for the four sides so that the interior baffles 26 can be stitched to each of the four sides before the four sides are joined along their vertical corners. Finally, the top and bottom panels are stitched along, respectively, the top and bottom perimeters of the four sides to form the completed bag.

It will appreciated that with this prior art structure not only will the completed bag still tend to bulge in an undesirable manner when filled with cargo, but each of the four outer sides of the bag will have at least two vertical lines of heavy stitching 28, used for attaching the corner baffles 26. These lines of heavy stitching interfere with the placement of graphics and printing on the outside surfaces of the bags and impair the strength and integrity of the bags, as discussed above.

Figure 3:
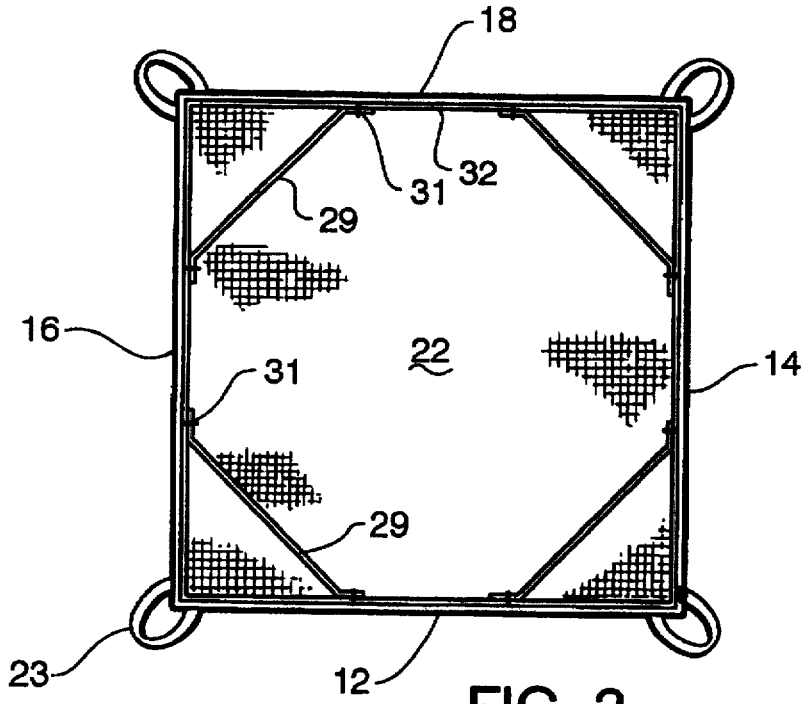
FIG. 3 is a plan view of the improved rectilinear bulk cargo bag of FIG. 1 and showing details of the inner liner and baffle attachment.
Figure 4:
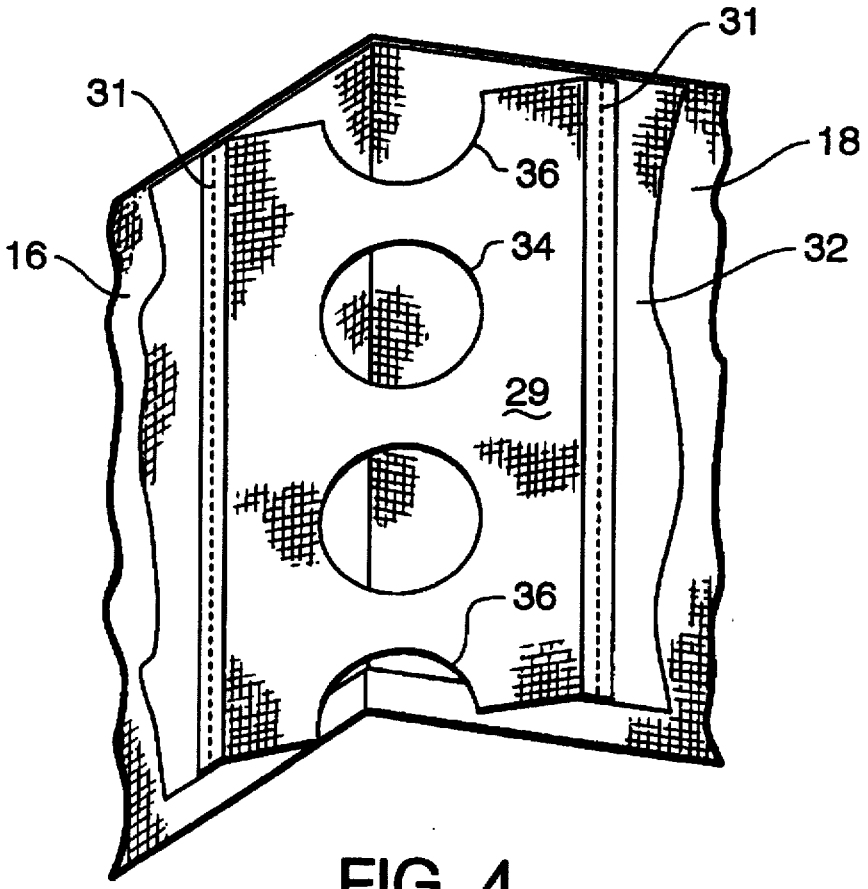
FIG. 4 is a perspective detail view of a portion of the bag of FIGS. 1 and 3, illustrating one of the corner baffles used in the bulk cargo bag.
Figure 5:
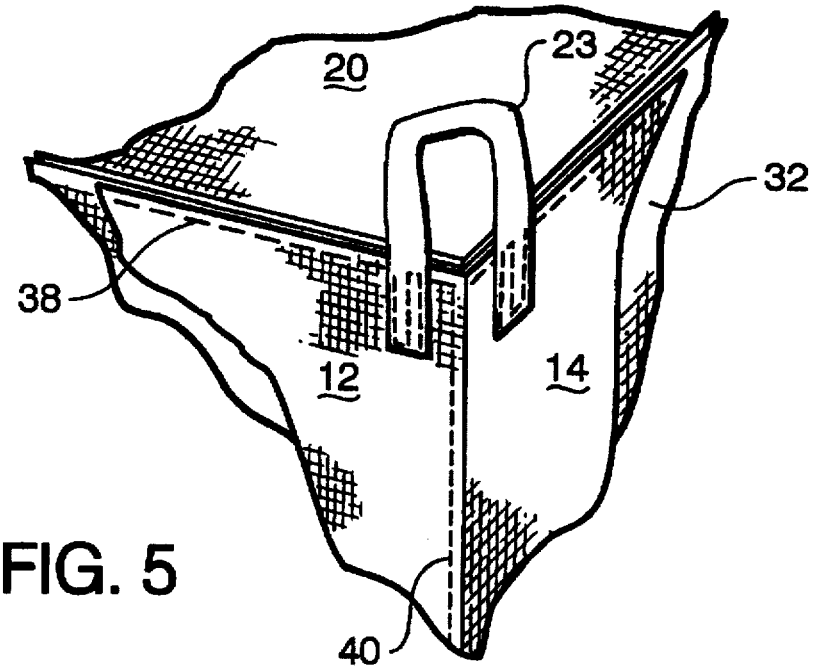
FIG. 5 is a fragmentary perspective view of one exterior corner of the bag of FIGS. 1 and 3, showing details of the assembly of the components of the bag.
Figure 6:
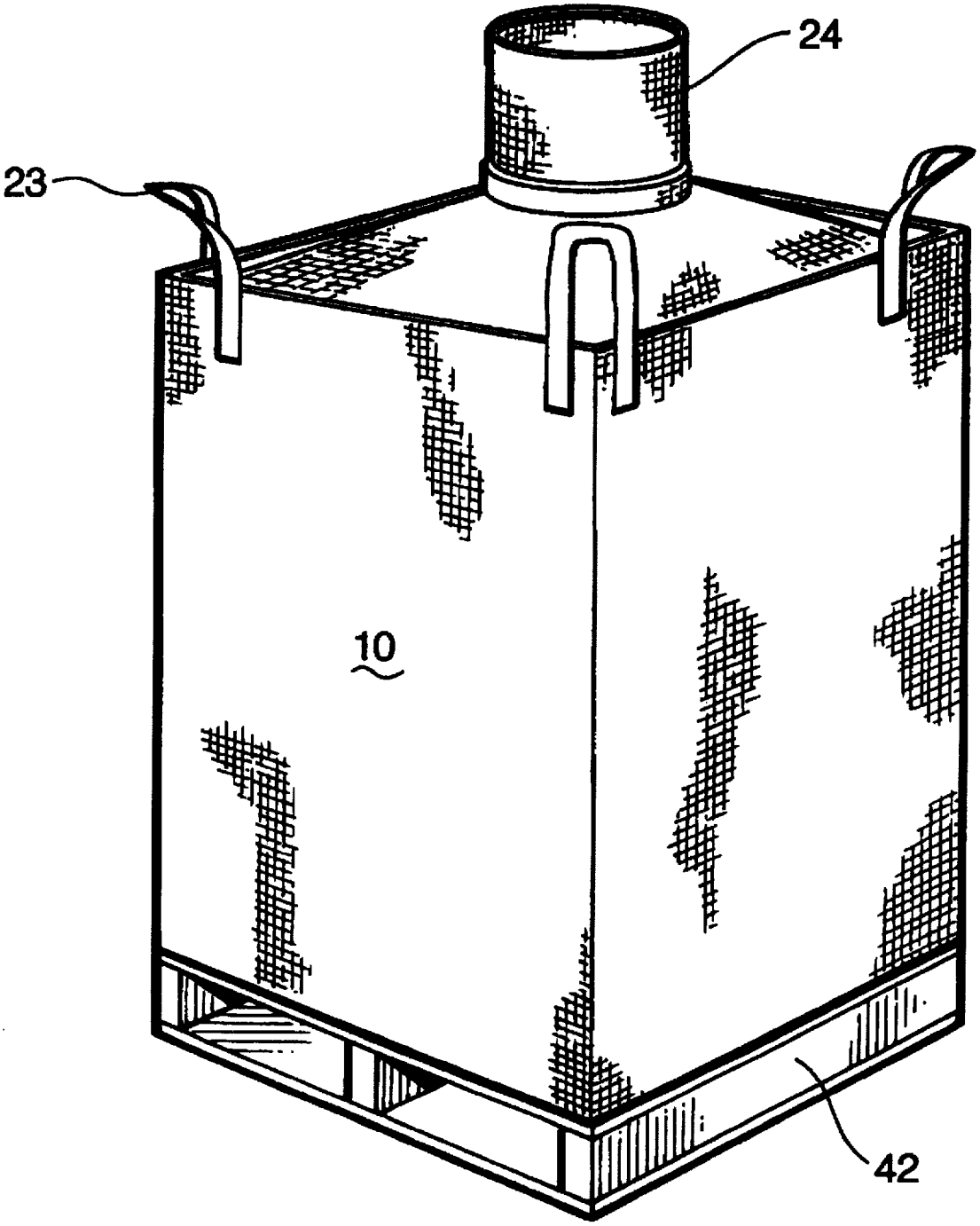
FIG. 6 is a perspective view of a bulk cargo bag as shown in FIG. 1 with its bottom resting on a cargo pallet, to which it is attached.

Referring now to FIGS. 3 through 5, there are illustrated details of construction of the improved bulk cargo bag 10 in accordance with the present invention. The four walls, top, bottom and handle portions are as described in connection with FIG. 1. As pointed out above, in some applications, the top panel and closure means may be omitted, and the bag used in an open-topped configuration or with a top skirt used for closure.

Four elongated corner baffles 29 are disposed inside the bag, but instead of being stitched to the outer bag walls, each baffle 29 is attached instead along its two outer vertical edges by stitching 31 to a liner 32. The liner 32 preferably is formed of the same woven polymer fabric as the bag body, but other materials can be used if desired. Also, the liner may be of a lighter weight fabric than the outer walls. While stitching is the preferred form of attachment of the baffles to the liner, it will be appreciated that the baffles may be attached by other means such as, for example, adhesively, by staples, by sonic or thermal bonding of the liner and baffle fabrics, etc.

The liner 32 extends entirely around the inside walls of the bag 10, in parallel relationship to the walls. The liner extends from substantially the top to near the bottom of each of the four walls of the bag, but preferably stops short of, and does not engage, the bottom of the bag. This facilitates assembly of the liner in the bag, since it will not interfere with the bottom of the bag. The distance above the bottom of the bag at which the liner terminates may vary, but preferably is at least about one inch and not more than about six inches. Alternatively, the liner may, if desired, extend for the full height of the four walls of the bag, so that it engages the bottom of the bag.

The liner 32 preferably is attached to the bag structure 10 only along its top peripheral edge, with the lower edge of the liner preferably being free from attachment to the bag body.

Each of the four baffles 29 is attached to the liner so as to form, ideally, in plan view, the hypotenuse of a right triangle, with each of the two triangle legs being of equal length and with the apex of each such triangle being positioned in one of the four corners of the bag body. The baffles 29 extend for substantially the height of the liner 32 and preferably terminate above the bag bottom, at the same point as the liner, so as not to interfere with the flow of bulk cargo out of the bag. Alternatively, if the liner is full length, the baffles still may be shorter than the bag walls. Each baffle has a plurality of longitudinal openings such as circular cut-outs 34 and semi-circular cut-outs 36 to permit the dry bulk cargo to flow into and out of the area of the bag body behind the four baffles 29 as the bag is filled and emptied.

As illustrated in FIG. 5, in assembling the final bag structure, the liner 32, with the baffles already attached, is inserted into the bag body before the top is sewn on. The upper peripheral edge of the liner 32 preferably is then attached to the top edges of the four sides by peripheral stitching 38. Alternative attachment means, such as stapling, gluing, heat bonding, etc. also may be used. The top 20, if used, may be joined to the four sides in the same or a subsequent step. Vertical stitching 40 also may be used to join the side portions, or if adjacent sides are formed from a single web, to stitch together portions of the web adjacent to the intended vertical corner so as to assist in shaping the bag. It will be appreciated that, throughout the disclosure, wherever one line of stitching is shown, two or more lines may be used if desired for strength or other attachment means may be used.

The handles 23 preferably are joined to the body of the bag by separate stitching.

It will be appreciated that with the structure illustrated, the interior corner baffles 29 perform the same bracing and anti-bulging functions as the prior art baffles 28. However, since they are not attached to the outer walls of the bag, this leaves much larger portions of the four outside walls of the bag free of stitching and available for imprinting of graphic or textural material. Also, it has been found that, with the structure illustrated, the outside walls of the bag retain a flatter shape and the overall bag has a more square configuration than with prior art bags, due perhaps to the smoothing effect which the additional liner 32 has compared to the prior art structure.

In its preferred form, the inner liner 32 is continuous, being formed of one piece of woven material, having a height preferably slightly less than the height of the bag walls and an assembled length corresponding to the sums of the widths of the four bag walls. It can be formed from a rectangular piece of material, joined at its ends, or from a length of continuous woven tubular material. The four corner baffles are sewn, or otherwise attached, into the liner, prior to the assembled liner and baffles being inserted into the assembled outer bag, after which the top is added and the entire structure perimeter stitched, or otherwise joined, around the top edge. The bag bottom may be added either before or after the liner and baffles.

It has been found that the inner liner 32 also protects and seals the vertical corner stitches joining the four outer bag wall sections, where some sifting and leaking of powdery cargo typically occurs in prior art bags. Therefore, the improved construction of the present invention strengthens the overall bag construction, reduces the dust and powder of cargo sifting through seams, and improves appearance and functionality, as compared to the prior art structures.

In the prior art rectilinear cargo bags which contain corner baffles, the outer bag is formed of six panels to make the four sides, the top and the bottom, so that the baffles can be sewn through the side walls prior to final assembly. However, with the improved structure of the present invention, since it is not necessary to stitch the corner baffles to the outer bag walls, the bag walls may be made from a single panel or, if preferred, a continuous tube of woven material can be used to form all four side walls, with two additional panels being used for the top and bottom.

Referring now to FIG. 5, there is illustrated a bulk cargo bag of the type shown in FIG. 1 with its bottom resting on, and attached to, a conventional cargo pallet 42. The bag is attached to the cargo pallet by any desired means such as adhesive, stapes, etc. This combination of the cargo bag and pallet provides for improved stability, stackability and handling characteristics and makes for easy handling of the loaded bags by conventional forklifts, whose tines are designed for engaging and lifting cargo pallets. Where the cargo bags are directly affixed to cargo pallets, and designed to be handled by forklifts, other lifting means such as the loop handles 23 may not be needed and may be omitted.

The foregoing disclosure and description of the invention are illustrative only, and various changes can be made in the size, shape and materials of construction, within the scope of the appended claims, without departing from the spirit of the invention.

What is claimed is:

1. An improved bag for handling dry bulk cargo, said bag comprising:

a body comprising four sides and a bottom and approximating, when filled with cargo, the shape of a right quadrilateral prism, with said four sides, in cross-sectional plan view, forming a quadrilateral shape with four corners;

lifting means attached to said body and adapted to cooperate with equipment for handling said bag;

a woven fabric liner disposed inside said body adjacent the inside surfaces of said four sides, said liner being joined only along its upper periphery to said four sides of said bag body, said liner being open topped and open bottomed and terminating short of the bottom of said bag;

four generally vertical baffles disposed inside said liner and joined to said liner, but not to said sides of said bag body, along substantially the entire length of the vertical edges of said baffles, said baffles and said liner forming, in cross-sectional plan view, a generally quadrilateral shape having four generally triangular shapes therein, with one such triangular shape having its apex in each of said four corners of the bag body, said baffles and said liner being adapted to offset at least a portion of the lateral cargo loading forces on said four sides of said body to thereby reduce bulging of said four sides, whereby the generally prismatic shape of the filled bag is improved.

2. The bag according to claim 1 wherein each of said vertical baffles terminates short of said bottom of said bag body.

3. The bag according to claim 1 wherein each of said liner and said baffles terminates at least one inch above the bottom of said bag.

4. The bag according to claim 1 wherein each of said baffles has a plurality of openings therein through which cargo may flow, so as to facilitate the filling and emptying of said bag.

5. The bag according to claim 1 wherein said lifting means comprise four loop handles disposed at the four upper corners of said bag body.

6. The bag according to claim 1 wherein said lifting means comprise a cargo pallet attached to the bottom of said bag.

7. The bag according to claim 1 wherein said four sides, top and bottom of said bag body are formed of a woven polymer fabric.

8. The bag according to claim 1 wherein said liner and said baffles are formed of a woven polymer fabric.

9. The bag according to claim 1 wherein said body comprises additionally a top attached to the upper periphery of said four sides.

10. The bag according to claim 1 comprising additionally reclosable opening means in said body for loading bulk cargo into said bag.

11. In a bulk cargo bag of the type comprising a body formed of four sides and a bottom assembled into a shape approximating a right quadrilateral prism, the improvement comprising:

a liner of woven fabric inside said body of said bag in engagement only with the inside surfaces of the four sides of said bag, said liner being open topped and open bottomed and terminating short of the bottom of said bag;

four generally vertical corner baffles disposed inside said liner and joined to said liner, but not to said sides of said bag body, along substantially the entire lengths of the vertical edges of each said baffle;

said baffles and said liner forming, in cross-sectional plan view, a quadrilateral shape having a generally triangular shape disposed in each corner thereof, with one such triangular shape having its apex positioned in each of said four corners of the bag body, to assist in preventing excessive bulging of said four sides of said bag body when said bag is filled with cargo.

12. The bulk cargo bag according to claim 11 wherein said body comprises additionally a top attached to the upper periphery of said four sides and reclosable opening means in said top for loading bulk cargo into said bag.

13. The bulk cargo bag according to claim 11 wherein said liner is free from attachment to said bag body at any point other than along the upper periphery of said liner.

14. The bulk cargo bag according to claim 11 wherein each of said vertical baffles terminates short of said bottom of said bag body.

15. The bag according to claim 11 wherein each of said baffles has a plurality of openings therein through which cargo may flow, so as to facilitate the filling and emptying of said bag.

16. The bag according to claim 11 wherein said lifting means comprise four loop handles disposed at the four corners of said bag body.

17. The bag according to claim 11 wherein said lifting means comprise a cargo pallet attached to the bottom of said bag body.

18. The bag according to claim 11 wherein said bag body is formed of a woven polymer fabric.

19. The bag according to claim 11 wherein said liner and baffles are formed of a woven polymer fabric.

20. The bag according to claim 11 wherein said four sides of said bag body are formed from a length of continuous tubular material.

* * * * *